United States Patent [19]

Capostagno et al.

[11] 4,327,403

[45] Apr. 27, 1982

[54] LIGHTING FIXTURE WITH UNIFORM MOUNTING FRAME FOR OLD INSTALLATIONS

[75] Inventors: Joseph A. Capostagno, Somerset, Mass.; Kingsley Chan, Rutherford; Alexandre Kartavenko, Bayonne, both of N.J.

[73] Assignee: Lightolier Incorporated, Jersey City, N.J.

[21] Appl. No.: 147,853

[22] Filed: May 8, 1980

[51] Int. Cl.[3] ..... F21V 3/00

[52] U.S. Cl. ..... 362/306; 362/147; 362/296; 362/365; 362/368; 362/370; 362/371; 362/396; 362/406

[58] Field of Search ..... 362/306, 147, 296, 365, 362/368, 370, 371, 396, 406

[56] References Cited

U.S. PATENT DOCUMENTS

| | | | |
|---|---|---|---|
| 2,716,185 | 8/1955 | Burliuk | 362/366 |
| 2,998,511 | 8/1961 | Chan | 362/147 |
| 3,037,110 | 5/1962 | Williams | 362/147 |
| 3,169,007 | 2/1965 | Duffy | 362/366 |
| 3,268,721 | 8/1966 | Dworkin | 262/48 A |
| 3,286,090 | 11/1966 | Brown | 362/366 |
| 3,370,165 | 2/1968 | Chan | 362/311 |
| 3,801,815 | 4/1974 | Docimo | 362/366 |
| 4,175,281 | 11/1979 | Lonreth | 362/148 |

*Primary Examiner*—Stephen J. Lechert, Jr.
*Attorney, Agent, or Firm*—Arthur B. Colvin

[57] ABSTRACT

The present invention relates to a lighting fixture adapted to be mounted directly to the ceiling of a room or the like. A characterizing feature of the invention lies in the provision of a frame structure adapted to seat against the upper surface of the ceiling, the frame structure including means in the nature of clips which are shiftable radially into complementary guideways formed in the frame, the clips in the course of such outward radial movement including tangs which embed themselves in the ceiling structure proper to securely mount the fixture at a desired position in the ceiling.

8 Claims, 6 Drawing Figures

FIG. 1
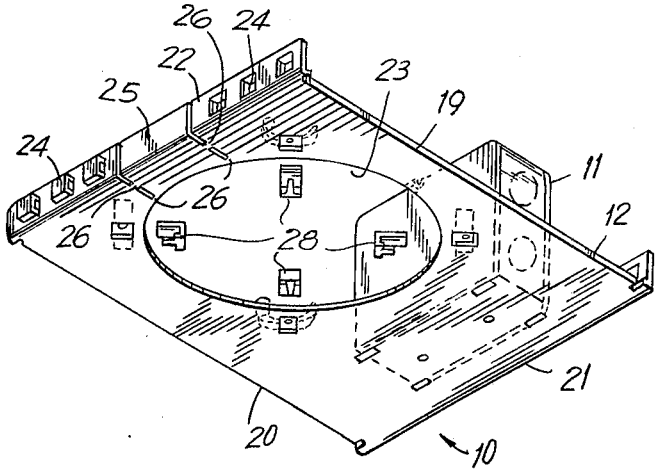
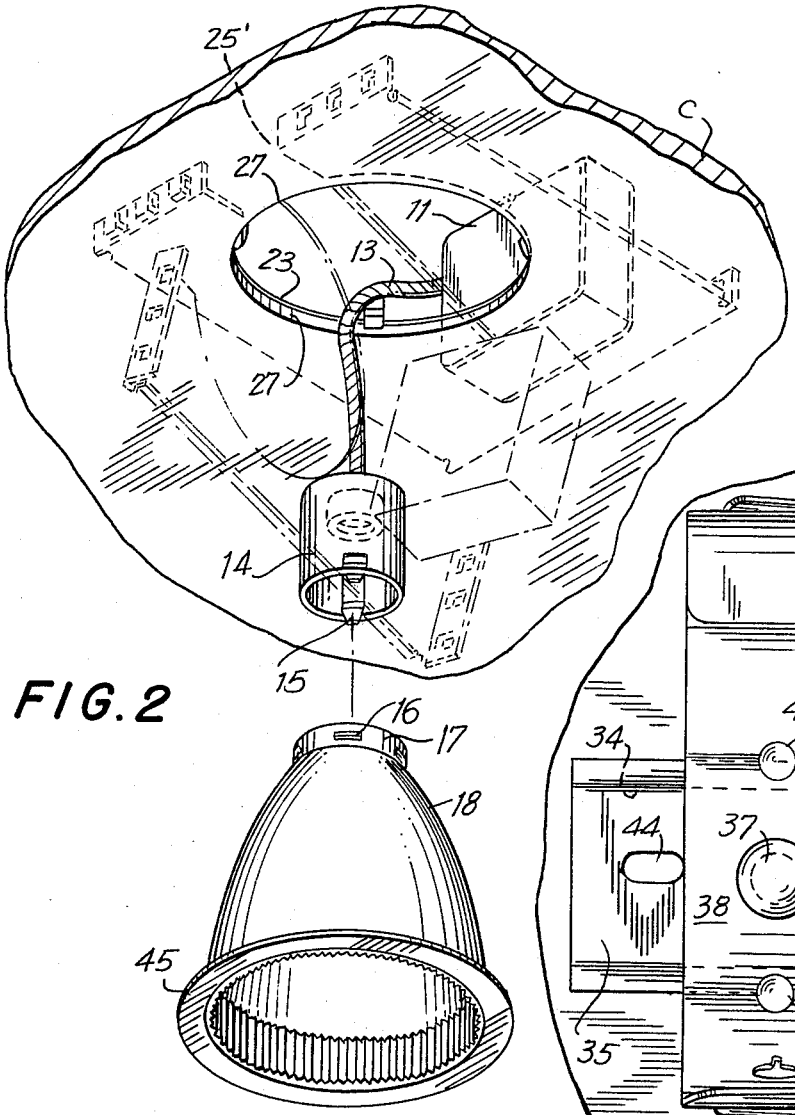
FIG. 2
FIG. 3
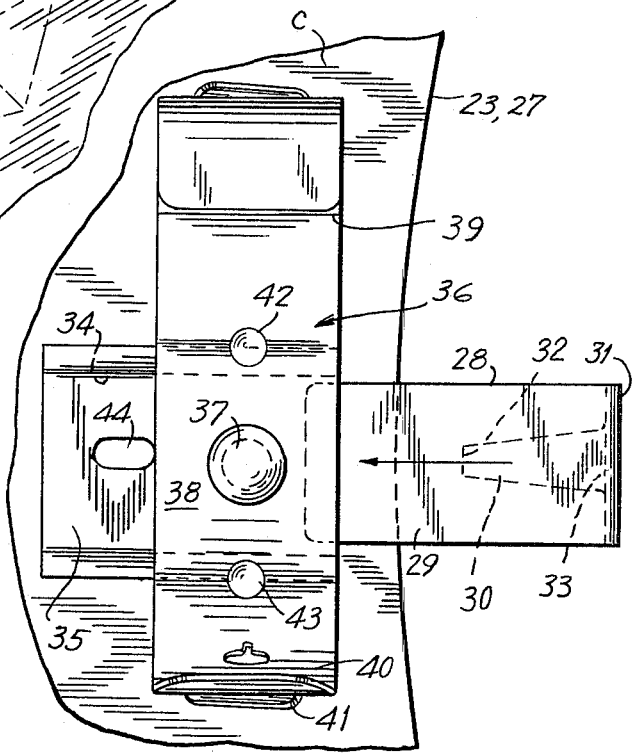

LIGHTING FIXTURE WITH UNIFORM MOUNTING FRAME FOR OLD INSTALLATIONS

BACKGROUND OF THE INVENTION

1. Field of the Invention

The present invention is in the field of lighting fixtures and relates more particularly to a ceiling mounted lighting fixture especially adapted to be installed on previously existing ceilings.

2. The Prior Art

The typical ceiling mounted lighting fixture is comprised of a frame having means thereon for securing the frame to the structural supports for a ceiling. In a typical installation for example where ceiling tiles or gypsum board will form the ceiling structure, the frame of the lighting fixture may include holes or brackets through which fasteners may be passed and led into the joists supporting the ceiling whereby the frame is securely positioned. In the so called hung ceiling installations, a metal gridwork is suspended in spaced relation to the overhead structure and the frame of the lighting fixture is provided with guideways or like means for interconnection with the grid components for supporting the fixture at a desired position. In both of the noted types of ceiling installations, the installer has access to the structural members from which the ceiling is hung and is thus readily able to attach the lighting fixture to such structural elements.

Lighting fixtures of the type here and above described however, are not readily suited for connections to or installations within pre-existing ceilings.

SUMMARY OF THE INVENTION

The present invention may be summarized as directed to a lighting fixture especially adapted to be supported solely from the material of which the ceiling is formed. The fixture in accordance with the present invention may be installed from a position below the ceiling by merely cutting a hole in the existing ceiling of a size corresponding to the reflector portion of the lighting fixture passing the fixture upwardly through the hole to a position above the ceiling and by the actuation of fastener components carried by the fixture securely mounting the frame to the ceiling by connection directly to the ceiling material proper.

Still more particularly, the present invention is directed to a lighting fixture comprising a frame which is preferably generally rectangular in plan including side rails and end rails, the rails together defining a central opening for the reception of a reflector. One of the rails is formed with a transverse passage or with a breakaway section enabling a transverse passage to be formed therein. The passage enables the frame to be passed through an opening smaller than the outer plan dimensions of the frame by passing the ceiling into the transverse passage formed in the rail and tilting the fixture to a position above the ceiling in a manner more fully described hereinafter. After the fixture is placed above the ceiling in registry with an aperture formed therethrough, a plurality of clips are slid radially outwardly into complemental guideways formed for such clips. The clips include upperlegs received within the frame guideways and lower or penetrating legs which are imbedded into the material of the ceiling, the imbedded clips firmly locking the frame in mounted position in the ceiling.

It is accordingly an object of the invention, to provide an improved ceiling fixture wherein the ceiling supports the fixture directly thereby enabling the mounting of the fixture to pre-existing ceiling structures without the necessity of effecting attachments to the supporting structures which hold the ceiling in position. A further object of the invention is the provision of a lighting fixture of the type described wherein the mounting thereof maybe effected by the simple procedure of cutting a circular hole in a pre-existing ceiling of a size calculated to receive the reflector intended to be used with the fixture, passing the fixture upwardly through the hole, securing the fixture in position above the ceiling by mounting clips which in the course of positioning within the fixture also penetrate the ceiling proper whereby a fixture may be securely mounted in an existing ceiling without the necessity of forming any connection to the joists, grids or other support network from which the ceiling is hung.

To attain these objects, and such other objects as may appear herein or be hereinafter pointed out, reference is made to the accompanying drawings in which:

FIG. 1 is a bottom perspective view of the frame component of a lighting fixture in accordance with the invention.

FIG. 2 is a bottom perspective view of a ceiling illustrating the manner in which the lighting fixture is passed from a position below to a position above the ceiling.

FIG. 3 is a magnified fragmentary section illustrating in detail the operation of inserting a support clip into assembled relation with the frame and with the ceiling structure.

Figure 5:
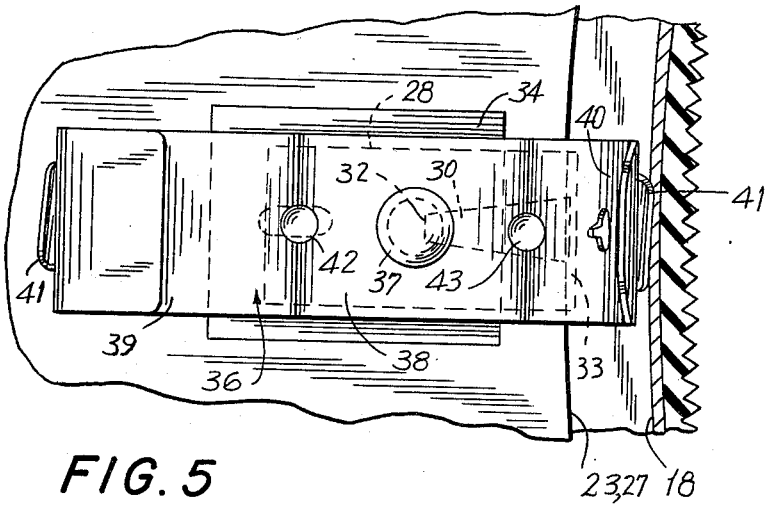
FIG. 5 is a magnified section taken on the line 5—5 of FIG. 4.

Referring now to the drawings, there is shown in FIG. 1, a frame 10 of a lighting fixture in accordance with the invention. As is typical, the frame 10 carries a junction box 11 on the upper surface 12 thereof. The junction box 11 may be connected to the mains wires which are previously run above the ceiling structure prior to positioning the fixture. Similarly, a BX cable 13 extending from the junction box 11 is pre-installed to bulb receptacle housing 14, providing electrical communication to the junction box. The bulb housing 14 may include a spring clip assembly 15 adapted to be engaged in the clip receiver slots 16 formed on the collar 17 defined at the upper end of the reflector housing 18. Since the construction as herefore described is altogether conventional, further description of the details need not be made. The frame 10 which as shown is generally rectangular in plan includes side rails 19, 20 and back and front rails 21, 22 respectively.

A circular cutout 23 is formed in the frame member 10, the cutout being sized to permit the passage therethrough of the reflector 18.

Frame 10 may include conventional guide members e.g., 24, 24 for the reception of the usual frame carrier struts which are employed when the frame is to be used in conjunction with a hung ceiling gridwork. As will be evident to those skilled in the art familiar with conventional hung ceiling installations, the frame as heretofore described is suited for use in such installations as well as for direct ceiling mounting in the manner hereinafter set forth.

In order to enable the fixture to be mounted above a pre-existing ceiling, the front rail 22 is provided with a breakaway section 25, which is connected to the main body of the frame by tab components of reduced length 26. Where the device is to be installed into a pre-existing ceiling, the section 25 is removed (see FIG. 2 for example) by breaking the tab sections 26. Removal of the section 25 enables the frame 10 to be passed through an aperture 27 formed in the ceiling, the aperture being cut to a diameter corresponding substantially to the diameter of the aperture 23 in the frame. The frame 10 is moved to a position above the ceiling after removal of the breakaway section 25 by tilting the frame 10 so that the same is in an essentially vertical plane and shifting the frame bodily laterally with the frame at a heightwise orientation, such that the ceiling passes through the gap 25' left by removal of the section 25. With the frame oriented in the manner described it is a simple manner to jockey the frame relative to the ceiling while the frame is angularly oriented relative to the ceiling and while the ceiling is disposed through the gap 25'.

When the whole of the rear rail 21 is disposed at a level above the ceiling, the frame may thereupon be returned to an essentially horizontal plane and shifted laterally to align the aperture 23 within the frame with the aperture 27 cut into the ceiling. During the mounting procedure, the bulb housing 14 and its attaching cable 13 are permitted to hang downwardly through the aligned apertures in the frame and ceiling.

Figure 4:
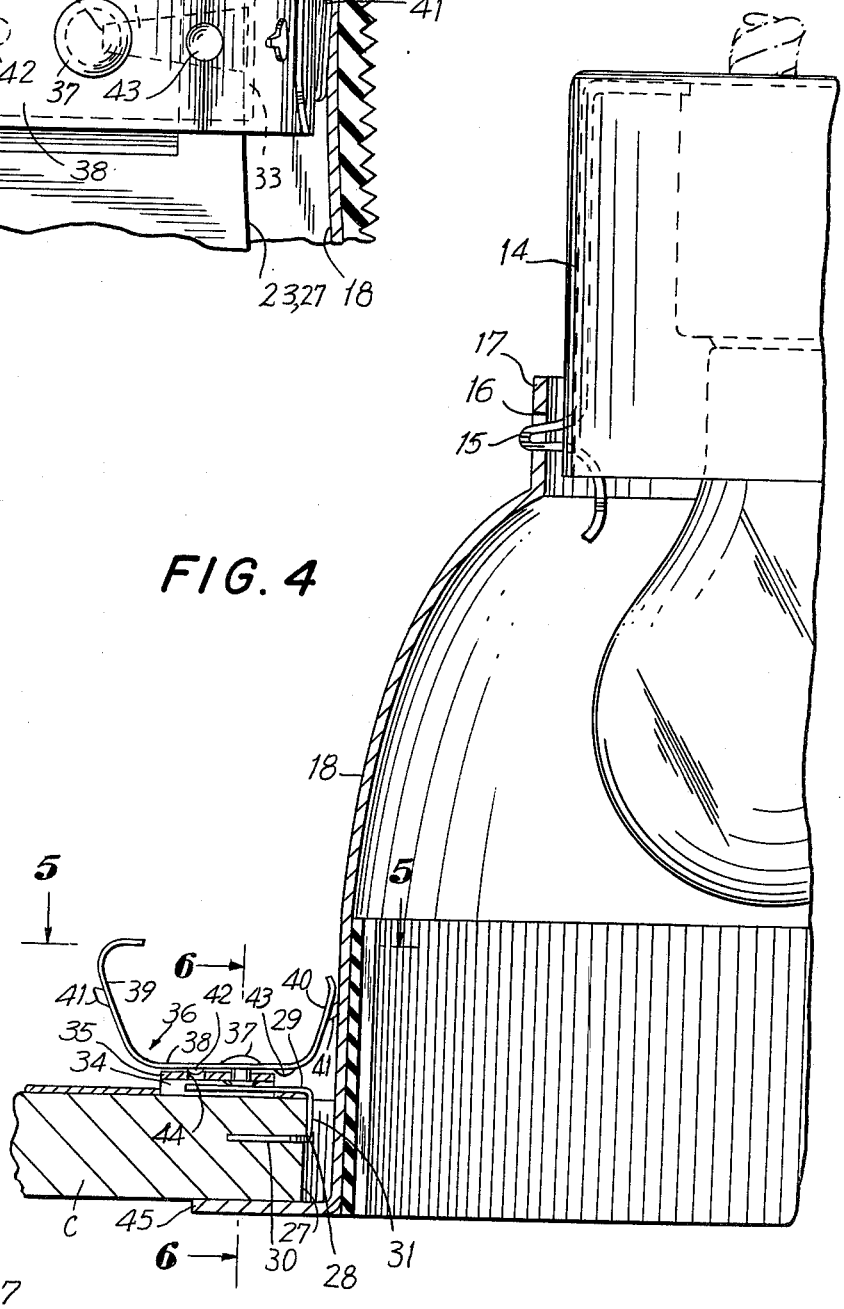
FIG. 4 is a magnified fragmentary vertical section through a lighting fixture in accordance with the invention showing the position of the parts in the assembled condition in a ceiling structure.
Figure 6:
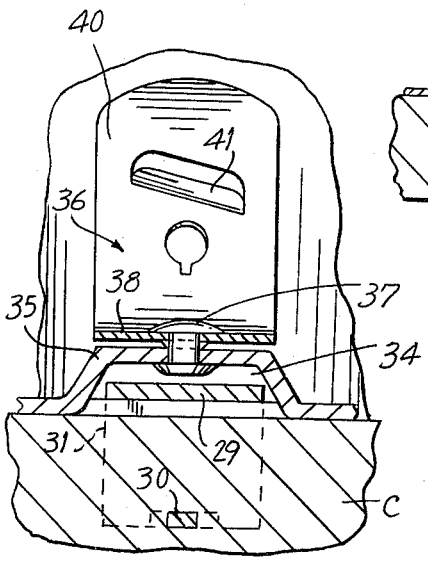
FIG. 6 is a section taken on line 6—6 of FIG. 4.

The actual affixation of the frame in permanent supported position relative to the ceiling is effected through the use of a series of clip members 28, the configuration of which is best appreciated from an inspection of FIGS. 3, 4 and 5. The clip members 28 are essentially U-shaped in longitudinal section and include a first or upperleg 29, a lower or attachment leg 30 and a vertically directed connector branch 31 linking the upper and lower legs. As best seen in FIGS. 3 and 5, the lower leg 30 of the clip is shorter than the upper leg and also of narrower transverse dimension tapering from a narrow cutting edge 32 to a wider base portion 33 where the lower leg joins the branch 31.

The frame member 10 at its upper surface 12, includes a plurality of radially directed angularly spaced apart guideways 34 for the sliding reception of the upper legs 29 of the clips 28. The guideways 34 may comprise bands of metal 35 struck upwardly from the material of the frame 10 to provide clearance for the first legs 29 of the clips while limiting substantial lateral movements of the clips within the guideways.

While for purposes of clarity, substantial clearance spaces have been shown between the guideways 34 and the legs 29 of the clips 28, it should be understood that a tight frictional fit between the noted components which prevents relative movement between the clips and the frame after installation will be preferred in most instances.

As will be appreciated from the above discussion, actual attachment of the frame to the ceiling is effected by sleeving the legs 29 of the clips into the respective guideways 34 (4 in number being shown in the illustrated embodiment) and driving the clips radially outwardly into seated position within the guideways. The radial outward movement of the clips functions to imbed the attachment legs 30 of the clips firmly into the material of the ceiling C. As will be apparent to those skilled in the art, the configuration of the penetrating portion of the legs 30 may be varied in accordance with the material of the ceiling. Thus for instance, if the unit is to be applied to a tile ceiling of relatively soft consistency, the leg 30 may be relatively blunt and the side edges of the same may be of sawtooth configuration to minimize the danger of rearward movement and consequent dislodgement of the clip from the tile. On the other hand, where the device is to be applied to a plaster board ceiling, the leading end of the attachment leg 30 may be sharper than illustrated.

After mounting of the frame, it is appropriate to attach the reflector and bulb housing assembly 18 and 14 respectively to the frame 10. Mounting of the reflector is effected through the use of pivotal spring clips 36 pivotally secured as by rivets 37 to the metal guides 35. The clips 36 which are generally U-shaped in transverse section include a central branch portion 38 and mounting legs 39, 40 respectively. The mounting clip assembly 36 which is discussed in further detail in a copending application for patent, is adapted to support reflectors of a variety of sizes. Briefly, the ability of the clip to hold various sized reflectors is due to the differential spacing of the legs 39, 40 from the pivot point 37. The legs 39, 40 include upwardly directed tangs 41 which preferably have the configuration shown in U.S. Pat. No. 4,039,822.

When the size of the reflector to be mounted is determined the clips 36 are rotated from the inactive position shown in FIGS. 1 and 3 to an active position whereat either of the legs 39 or 40 project radially inwardly and overlap the aperture or cutout 23 formed in the frame 10. The clips 36 may be locked in the noted position by the interaction of detents 42 or 43 which project downwardly from the clip 36 and the latching aperture 44 defined in the metal guide forming member 35, it being understood that when the leg 40 is in the radial innermost position shown in FIG. 4 the detent 42 will lie within recess 44 and when the leg 39 is in the radial innermost position, the detent 43 will lie in the said recess.

When the clips are rotated to the appropriate position considering the diameter of the selected reflector, the reflector is positioned within the frame by merely forcing the same upwardly to the mounted position shown in FIG. 4. As is conventional the reflector 18 includes a radially outwardly directed flange 45 which underlies and outwardly laps the hole formed in the ceiling to conceal any irregularities which may have been formed in the ceiling in the course of cutting the hole.

As will be apparent from the foregoing, there is disclosed in accordance with the present invention a lighting fixture adapted to be supported directly to the ceiling forming material or, alternatively, in conventional manner to joists or a hung ceiling gridwork.

The frame includes a break-away rail member enabling the fixture to be passed upwardly from a position below to a position above the ceiling. Novel attachment means are provided which embed directly into the ceiling tile and firmly secure the fixture at a desired location.

It is to be understood that variations in detail may be made from the structure illustrated and described without departing from the spirit of the invention and accordingly the same is to be broadly construed within scope of the appended claims.

Having thus described the invention and illustrated its use, what is claimed as new and is defined by Letters Patent of the United States is:

1. A lighting fixture adapted to be mounted to a tile ceiling structure or the like having an aperture formed therein comprising a support frame including side and end portions defining a generally rectangular configuration having an opening, a transversely directed gap formed in one of said portions and extending to said opening, said frame including a generally planar undersurface portion adapted to rest on the upper surface of said ceiling surrounding said aperture, a plurality of angularly spaced apart guideway portions formed in said frame in proximate spaced relation to and extending in a direction generally parallel with said undersurface, a mounting member supported in each said guideway, said mounting members being generally U-shaped in transverse section and including a first leg slidably supported in said guideway for movement in a plane generally parallel with said undersurface, and a branch portion extending downwardly from said first leg to a position below the plane of said undersurface and an attachment leg of shorter length than said first leg and disposed in parallel spaced relation therebeneath, said attachment leg including a sharpened end portion adapted to be embedded into the material of said ceiling responsive to outward sliding movement of said mounting members in said guides, thereby clampingly to support said frame to said ceiling, said fixture including a reflector member and means for removably supporting said reflector member in said opening.

2. Apparatus in accordance with claim 1 and including detent means disposed in said guideways for frictionally retaining said first leg in a selected position in said guideway.

3. Apparatus in accordance with claim 2 whereon said guideway and said first leg are dimensioned slidably to guide said leg and hence, said mounting member, in a linear path relative to said frame.

4. Apparatus in accordance with claim 1 where said gap is defined by a removable portion of said frame.

5. A lighting fixture adapted to be mounted to a tile ceiling structure or the like having an aperture formed therein comprising a support frame including side and end portions defining a generally rectangular configuration having an opening, a transversely directed gap formed in one of said portions and extending to said opening, said frame including a generally planar undersurface portion adapted to rest on the upper surface of said ceiling surrounding said aperture, a plurality of angularly spaced-apart guideway portions formed in said frame in proximate spaced relation to and extending in a direction generally parallel with said undersurface, a mounting member supported in each said guideway, said mounting members being generally U-shaped in transverse section and including a first leg slidably supported in said guideway for movement in a plane generally parallel with said undersurface and a branch portion extending downwardly from said first leg to a position below the plane of said undersurface and an attachment leg disposed in generally parallel spaced relation therebeneath, said attachment leg, in the mounted position of said mounting members, being adapted to engage portions of said ceiling responsive to outward sliding movement of said mounting members in said guides, thereby clampingly to support said frame to said ceiling, said fixture including a reflector member and means for removably supporting said reflector member in said opening.

6. Apparatus in accordance with claim 5 and including detent means disposed in said guideways for frictionally retaining said first leg in a selected position in said guideway.

7. Apparatus in accordance with claim 6 whereon said guideway and said first leg are dimensioned slidably to guide said leg and hence, said mounting member, in a linear path relative to said frame.

8. Apparatus in accordance with claim 5 where said gap is defined by a removable portion of said frame.

* * * * *